US005209273A

United States Patent [19]

Giuffredi et al.

[11] Patent Number: 5,209,273

[45] Date of Patent: May 11, 1993

[54] SAFETY CABIN FOR LOADING FLAMMABLE PROPELLANTS INTO AEROSOL CANS

[75] Inventors: Giancarlo Giuffredi; Domenico Crespiatico, both of Milan, Italy; Carmelo Rigano, Saint Denis, France

[73] Assignee: Coster Tecnologie Speciali S.P.A., Italy

[21] Appl. No.: 893,780

[22] Filed: Jun. 5, 1992

[30] Foreign Application Priority Data

Jun. 7, 1991 [IT] Italy ..... MI91A 001569

[51] Int. Cl.[5] ..... B65B 31/00; B65B 3/04

[52] U.S. Cl. ..... 141/20; 141/3; 141/93; 141/97; 454/49; 454/57; 454/60

[58] Field of Search ..... 141/3, 20, 65, 66, 93, 141/94, 129, 168, 192, 196, 197, 97; 198/345.1; 109/49.5, 66; 454/49, 57, 60

[56] References Cited

U.S. PATENT DOCUMENTS 3,259,152 7/1966 Schimkat ..... 141/20
3,817,299 6/1974 Koehler ..... 141/82
5,016,688 5/1991 Suzuki et al. ..... 141/129

FOREIGN PATENT DOCUMENTS 831756 3/1960 United Kingdom ..... 141/20
1265349 3/1972 United Kingdom ..... 141/20

*Primary Examiner*—Henry J. Recla
*Assistant Examiner*—Steven O. Douglas
*Attorney, Agent, or Firm*—Steinberg & Raskin

[57] ABSTRACT

The cabin is integral with a shield which separates it from the working environment and which can replace a perimetral part of the wall or the like which separates said environment from the outside. In correspondence with said shield the cabin comprises a sealed (by suitable seal gaskets), flameproof and explosion-proof door providing access from said environment and comprising an armoured viewing window. On the side opposite that comprising the door the cabin has a movable wall which is hinged and ejectable. In the walls perpendicular to the preceding there are apertures or passageways for the entry and exit of the can conveyor. Analogous apertures or passageways are provided in the shield, these being at least partly closable by guillotine plates when required. In the region in which the conveyor extends in the open between the shield and cabin, means are provided to direct air streams onto the cans. The cabin, incorporating conventional means for loading the propellant (such as butane), comprises suction means with suction ports in correspondence both with the lower part of the cabin and with the delivery head of said loading means.

8 Claims, 5 Drawing Sheets

SAFETY CABIN FOR LOADING FLAMMABLE PROPELLANTS INTO AEROSOL CANS

This invention relates to a safety cabin for loading flammable propellant, such as butane, into aerosol cans, said cabin containing conventional loading means with a loading head and being also traversed by a continuous can conveyor.

For environmental reasons there is a tendency to replace fluorinated propellants with propellants of different type (such as butane and propane). These propellants of different type are notoriously flammable and can also explode in suitable mixture with air. Their use therefore requires adequate safety measures.

A usual solution is to load the flammable propellant in explosion-proof cabins. These cabins are located at a distance from the building without direct passage between the two. The positive side of this solution is that the dangerous part (cabin) is completely separated from the building in which the cans undergo other operations. The negative side is that this solution is costly, requires a remote monitoring system and involves production line maintenance, and any format change (requiring the production line to be adapted to the different can size or format) means that the operator has to leave the building and enter the cabin, which must therefore be of such a size as to allow him to operate about the means contained therein.

The main object of the present invention is to provide a cabin which although offering maximum safety is of compact size, is directly accessible from the production department without having to leave this latter, and enables the operation of the means situated within it to be directly viewed.

A further object of the present invention is to provide a cabin to which access is conditional on the state of the environment within it.

These and further objects which will be more apparent from the detailed description given hereinafter are attained by a cabin of the stated type, essentially characterized by being associated with a shield which outwardly bounds the production environment such that the cabin is external to although in contact with this environment, and by comprising, towards this environment, an armoured access door the opening of which is conditional on the existing state within the cabin as determined by sensors, and, on the opposite side to said environment, a hinged wall openable by swinging, within two walls perpendicular to the door and to the hinged wall there being provided passageways for the entry and exit of the can conveyor, which in entering and leaving the production environment passes through at least partially closable passageways provided in the shield and remains exposed along its path between the shield and the cabin and between this latter and the shield, suction means being associated with the cabin to create suction at the level of the loading head and at the bottom of the cabin, and to discharge the indrawn air to the outside.

According to a preferred embodiment of the invention, above that or those path portions in which the conveyor remains exposed outside both the cabin and the production environment, forced air streams are provided in such a manner that they strike the cans.

The invention will be more apparent from the detailed description of a preferred embodiment thereof given hereinafter by way of non-limiting example with reference to the accompanying drawing, in which.

Figure 1:
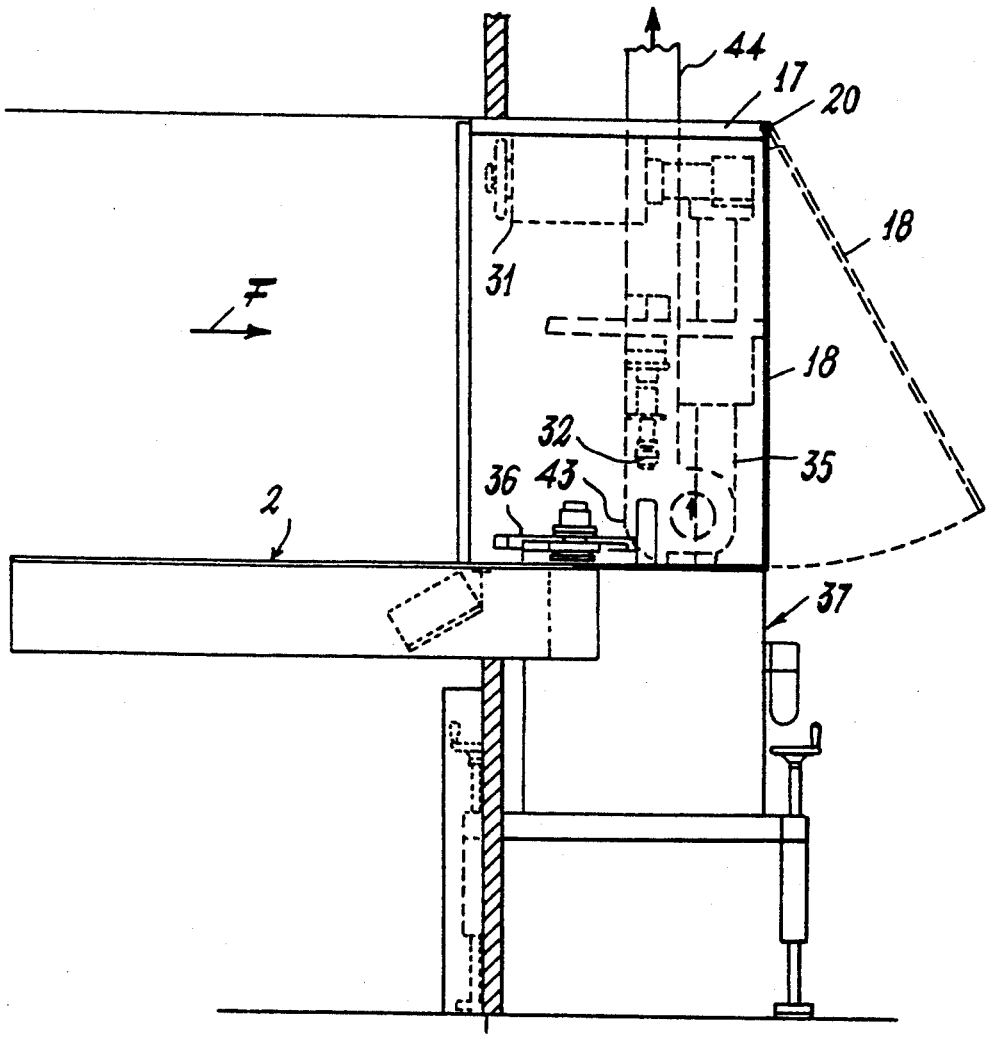
FIG. 1 is a schematic vertical sectional view of the invention.
Figure 2:
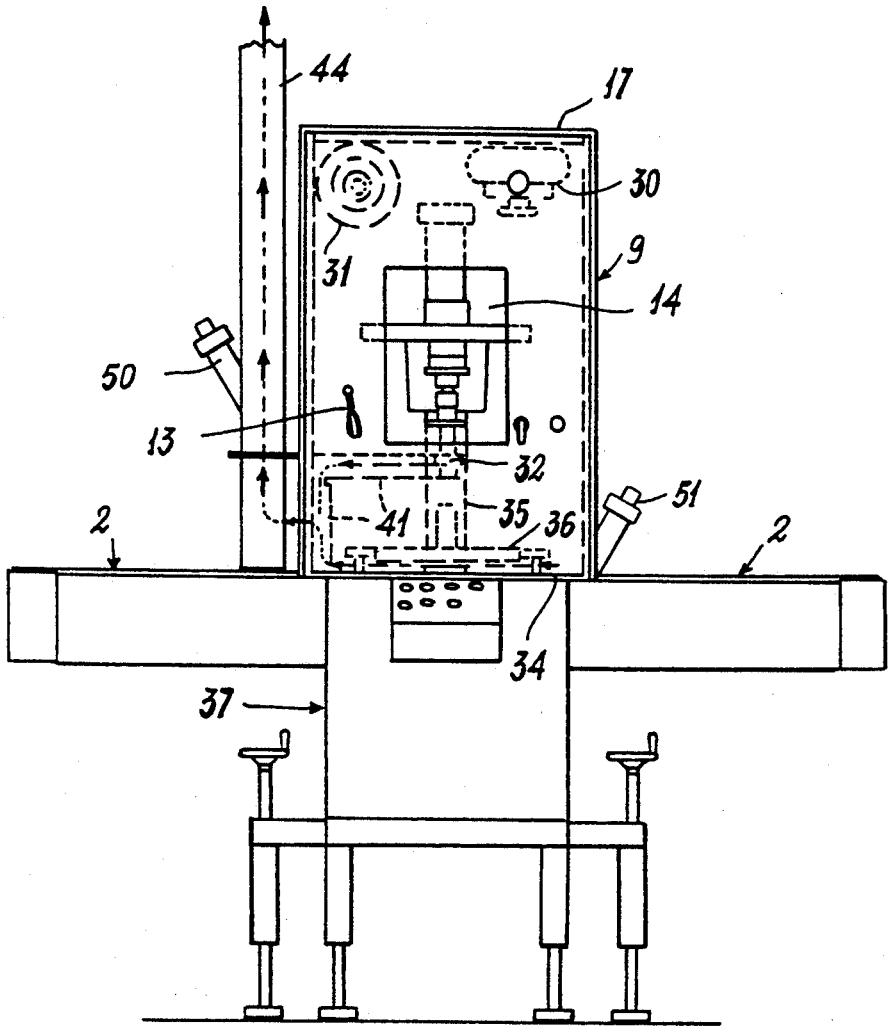
FIG. 2 is a schematic view taken in the direction of the arrow of FIG. 1, but without the shield associated with the cabin.

In the figures, the reference numeral 1 indicates the production department in which various conventional operations are performed on the cans B, and within which there extends a conveyor belt 2 by which the cans are conveyed. The production department is bounded towards the outside by a wall 3 in which there is provided a rectangular or square aperture 4 which is closed by a robust closure means 5, for example a steel plate 2–3 cm thick, secured in conventional manner to the surrounding of the aperture 4 and known hereinafter as the "shield".

In the shield 5 ther are provided two passageways 6 and 7 through which the conveyor 2 passes to the outside of the environment 1.

The shield 5 comprises a substantially rectangular aperture 8. A box structure of corresponding form is rigid with this aperture and projects slightly into the environment 1, for example by a few centimeters, whereas it projects considerably outwards. The box structure is closed on the side facing the environment 1 by a sealed armored flameproof door 10 hinged at 11 along its vertical side to a robust metal frame 12 rigid with the shield 5. A lever 13 mounted on the door controls conventional bars 72 (see FIG. 7) which enter seats 73 in the frame 12 to maintain the door closed, this being provided with perimetral seal means to seal against the edge of the box structure at that part thereof which projects into the environment 1.

Figure 3:
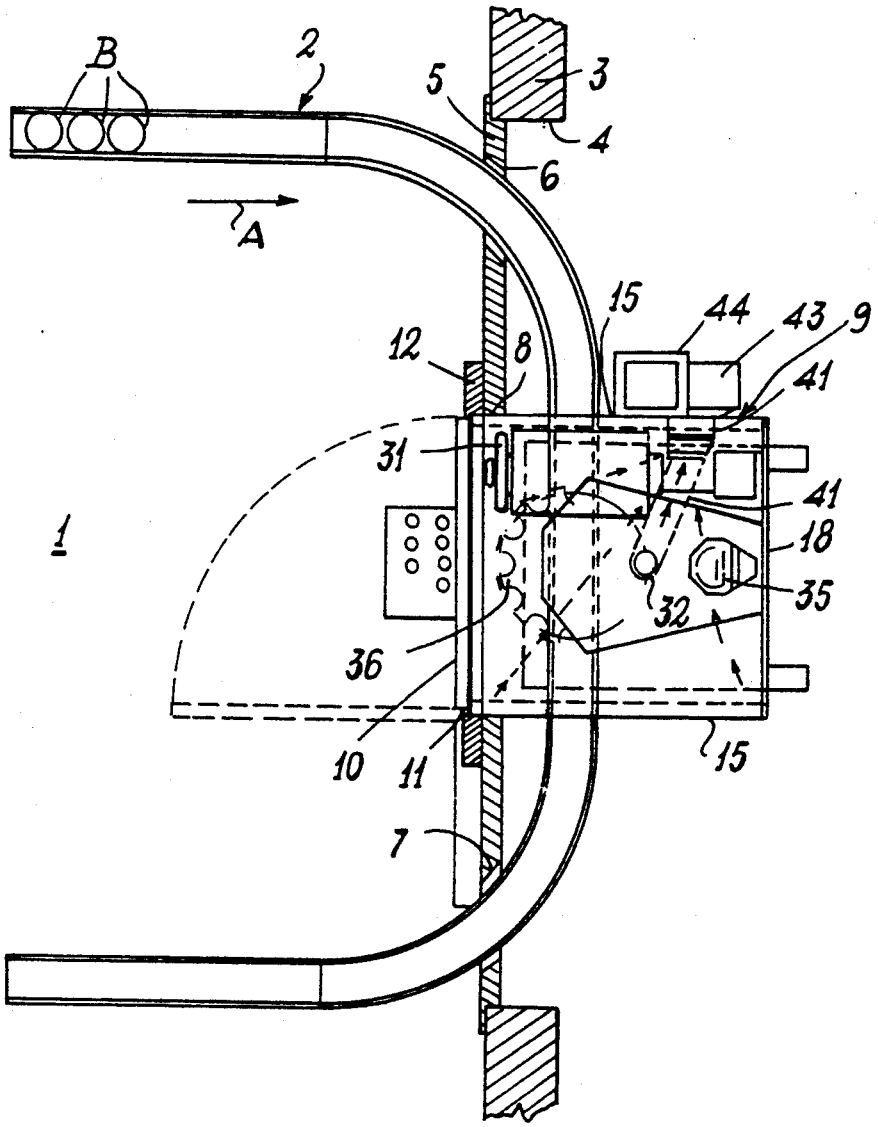
FIG. 3 is a view from above of the cabin, showing the shield sectioned at the level of its passageways for the can conveyor.

On rotating the lever 13 the bars 72 are withdrawn from the seats 73 so that the door can be rotated into its open position, as shown by dashed lines in FIG. 3.

A sheet of armoured glass 14 is mounted in the door 10 to enable the interior of the box structure 9 to be viewed.

The box structure 9, which forms the actual safety cabin in which the propellant is loaded into the cabins, is traversed by the conveyor 2 which extends through apertures or passageways 14 provided in the two side walls 15 of the box structure, these side walls being constructed, as are the floor 16 and roof 17, of metal plate of adequate thickness to support the operating means contained in said structure.

The rear wall 18 of the structure 9 is formed from a transparent sheet of light material, preferably makrolon, hinged at 20 to the roof 17 of the structure and resting against the edges of the remaining walls which bound it. The hinging is such that if an explosion occurs in the cabin, the sheet is ejected. The relative technology is conventional.

Figure 6:
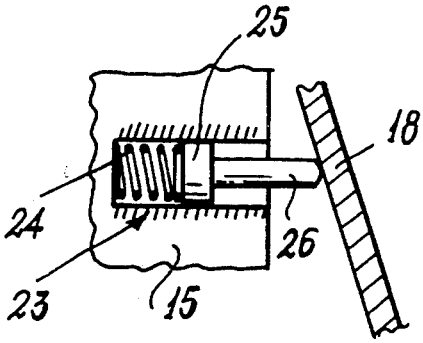
FIGS. 6 and 7 are schematic views of a detail relative to the door and a detail of the cabin door closure means.

A single-acting pneumatic cylinder 23, its piston 25 loaded by a spring 24 counteracting the pneumatic thrust, is fixed to one of the side walls 15 (see FIG. 6). The piston has a rod 26 with its end rounded to act on the sheet 18. When pneumatic pressure acts within the cylinder, the rod 26 withdraws into the cylinder 23 and the sheet moves by gravity into its closed position. When this pressure is absent, the rod 26 emerges under the thrust of the spring 24 to rotate the sheet into its open position, to allow atmospheric air to enter the interior of the structure 9. It should be noted that pneumatic pressure is fed to this cylinder when sensors (described hereinafter) sense the presence of a given excess of propellant within the structure 9. The use of transparent material for the movable wall 18 allows the contents of the box structure 9 to be illuminated naturally or artificially from the outside.

The interior of the box structure 9 houses the following:

a) a conventional $CO_2$ or fluorbrene automatic extinguisher which operates when the temperature in the cabin exceeds a set temperature, and which is supported by the roof 17;

b) a conventional propellant metering cylinder operated by compressed air and carried by the roof 17 or by a wall 15 and connected to a remote source of propellant and to a conventional propellant loading head 32;

c) the said pneumatically positioned loading head mounted on an adjustable support 35 which rises from the floor 16 of the structure 9;

d) a conventional mechanical can selector 36, the controls for which are arranged in a base 37 below the structure 9, to which it is connected and which supports said structure.

Figure 4:
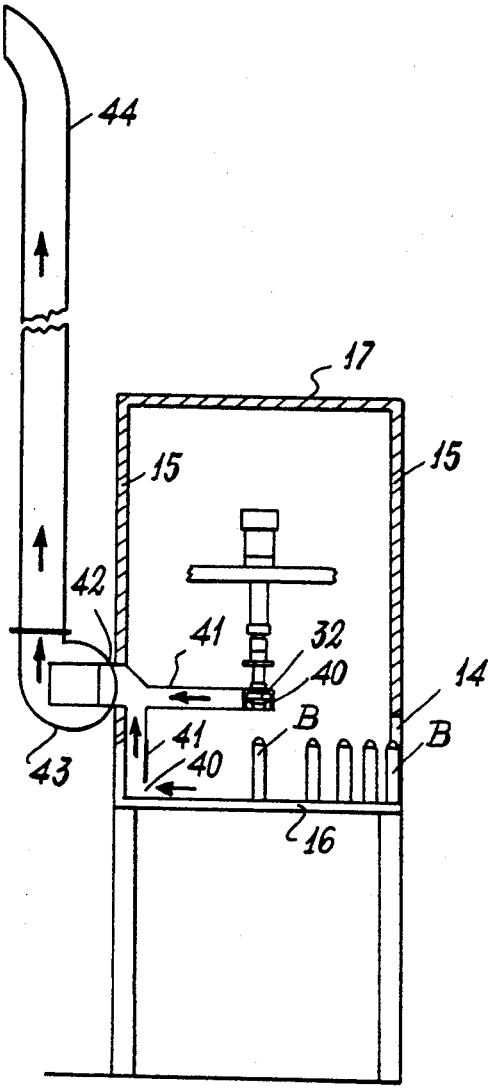
FIG. 4 is an even more schematic vertical cross-section through the cabin with parts omitted for clarity, said figure showing the suction means operating at the loading head and on the lower side of the cabin.

In correspondence with the loading head 32 and with the floor 16 of the structure 9 there are provided suction ports 40 (see FIG. 4) which, via ducts 41 within the structure 9, lead to a manifold 42 emerging from said structure and opening on the suction side of a centrifugal fan 43, the delivery side of which is connected to a discharge stack 44. This removes from the structure 9 any possible propellant losses.

In the stack 44 there is positioned a first conventional propellant gas sensor (catalytic sensor) 50 which feeds its electrical output signal to a central control unit, not shown, which also receives the signal from a second gas sensor (catalytic sensor) 51 positioned on the opposite side of the structure 9 in its lower part. In known manner, these sensors measure the propellant gas concentration and emit an electrical signal proportional to the measured concentration. The central control unit, not forming part of the invention, compares the received signals and on the basis of these exercises control in the manner briefly described hereinafter.

Figure 5:
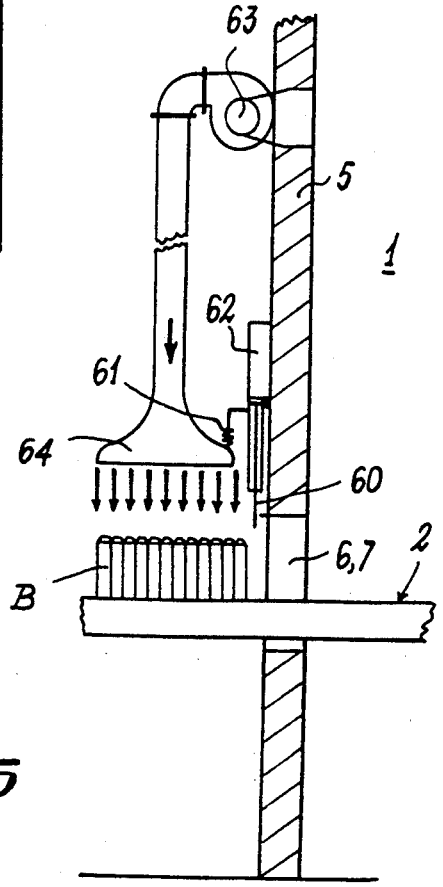
FIG. 5 is a schematic view of the means for closing the passageways in the shield and the means for providing the air streams within the exposed portions of the can conveyor.

As shown schematically in FIG. 5, a device is provided at the passageways 6, 7 to partially close them. These devices consist of a guillotine shaped plate 60 which a spring 61 tends to maintain in the closed position, whereas a pneumatic cylinder 62 tends to maintain the plate in the open position. The guillotine plates are guided in vertical guides, not shown, provided on the outer face of the shield 5, to which the cylinder 62 is connected.

Along those portions of the conveyor 2 which extend between the passageways 6, 7 in the shield and the corresponding passageways 14 in the structure 9 the cans B are struck from above by streams of air (FIG. 5) drawn from the environment 1 by the centrifugal fan 63 and fed via a distributor 64 connected to the fan delivery. Said air streams can also originate from air drawn from the outside of the environment 1 provided it is not contaminated with flammable gas.

Figure 7:
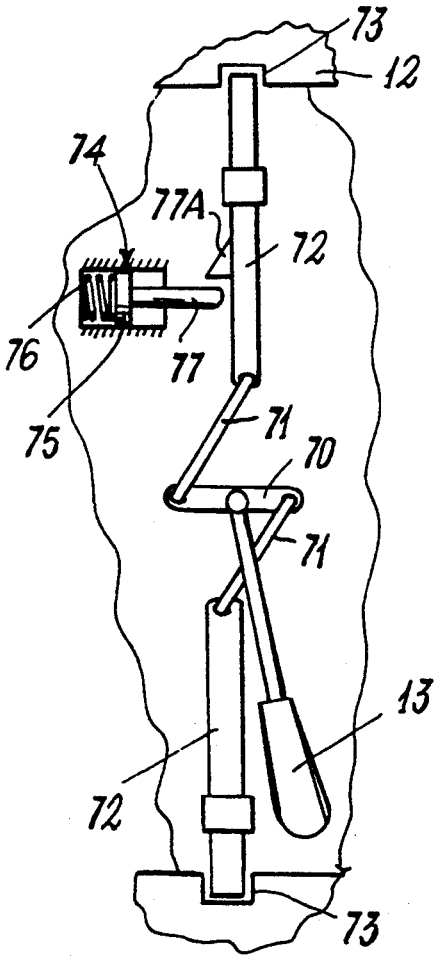

The mechanism for closing the door 10 is shown schematically in FIG. 7. The lever 13 mounted rotatably on the door is rigid with an arm 70. The ends of the arm are hinged to linearly guided bars 72 which can engage seats 73 in the frame 12. In the frame or rather on the door there is provided a single acting pneumatic cylinder 74, on the piston 75 of which there acts a spring 76. If pneumatic pressure is absent the piston rod 77 lies below a tooth 77A on one of the bars and prevents door opening. If instead pressure is present, the door can be opened as the rod 77 has withdrawn into the cylinder.

During normal operation the door 10 is closed but can be opened because the rod 77 does not lie below the tooth 77A. The fans 43 and 63 are in operation, the movable wall 18 is in its closed position and the guillotine plates 60 are raised. If the propellant concentration increases just slightly the door can still be opened, but in this case pneumatic pressure to the cylinder 23 is shut off with the result that the movable wall 18 rotates into its open position under the thrust of the spring 24, and external air enters the cabin. If in spite of this the concentration still rises, pneumatic pressure is no longer fed to the cylinder 74 so that the door 10 cannot be opened, the guillotine plates 60 are lowered and production stops, whereas the fans remain in operation and the movable wall 18 remains open.

What I claim is:

1. A safety cabin, having a front, rear and two side walls for loading flammable propellants into aerosol cans, which contains conventional loading means with a loading head and is traversed by a can conveyor which enters from and exits towards a working environment, characterized by being associated with a shield outwardly bounding said working environment, and by comprising an access door in said front wall facing towards and accessible from said working environment and an operable rear door in said rear wall provided outwardly opposite the access door, and a suction system with suction ports located at the level of the loading head and in the lower part of the cabin respectively, said can conveyor traversing through said shield and said side walls.

2. A safety cabin as claimed in claim 1, characterized by comprising a propellant concentration measurement means on the delivery side of the suction system and a second propellant concentration measurement means in the lower part of the cabin.

3. A safety cabin as claimed in claim 1, characterized in that controlled members for closing the conveyor entrance and exit in the shield are provided in correspondence with said entrance and exit.

4. A safety cabin as claimed in claim 1, characterized in that means for feeding an air stream onto the cans carried on the conveyor are provided along at least one of the open paths undergone by the conveyor between the cabin and the shield.

5. A safety cabin as claimed in claim 1, characterized in that the operable rear door is hinge-mounted and on it there acts a pneumatically operated contractile pusher member under the control of at least one of the propellant concentration measurement means in such a manner as to rotate said wall into its open position at a given propellant concentration in the cabin.

6. A safety cabin as claimed in claim 1, characterized in that the rear door is transparent.

7. A safety cabin as claimed in claim 1, characterized in that the rear door is comprised of armored glass.

8. A safety cabin as claimed in claim 7, characterized in that the door can be opened manually by a lever on which an opening prevention means acts under the control of the concentration measurement means.

* * * * *